US010618297B2

(12) United States Patent
Okumura et al.

(10) Patent No.: US 10,618,297 B2
(45) Date of Patent: Apr. 14, 2020

(54) TANK AND LIQUID EJECTION DEVICE

(71) Applicant: SEIKO EPSON CORPORATION, Tokyo (JP)

(72) Inventors: Hideki Okumura, Shiojiri (JP); Takashi Koase, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/216,290

(22) Filed: Dec. 11, 2018

(65) Prior Publication Data

US 2019/0176476 A1 Jun. 13, 2019

(30) Foreign Application Priority Data

Dec. 12, 2017 (JP) ..... 2017-237834

(51) Int. Cl.
*B41J 2/175* (2006.01)

(52) U.S. Cl.
CPC ..... *B41J 2/17523* (2013.01); *B41J 2/175* (2013.01); *B41J 2/17509* (2013.01); *B41J 2/17513* (2013.01); *B41J 2/17553* (2013.01)

(58) Field of Classification Search
CPC .... B41J 2/17523; B41J 2/175; B41J 2/17513; B41J 2/17553; B41J 2/17509
See application file for complete search history.

(56) References Cited

U.S. PATENT DOCUMENTS

| | | | | |
|---|---|---|---|---|
| 9,643,423 | B2 * | 5/2017 | Kimura | B41J 2/17509 |
| 10,259,229 | B2 * | 4/2019 | Kimura | B41J 2/17506 |
| 2015/0367648 | A1 | 12/2015 | Kimura et al. | |
| 2018/0111380 | A1 | 4/2018 | Kimura et al. | |
| 2019/0232669 | A1 * | 8/2019 | Kudo | B41J 29/13 |

FOREIGN PATENT DOCUMENTS

| | | | |
|---|---|---|---|
| JP | 2018-069717 | A | 5/2018 |
| WO | WO-2014/115506 | A1 | 7/2014 |

* cited by examiner

*Primary Examiner* — Huan H Tran
(74) *Attorney, Agent, or Firm* — Foley & Lardner LLP

(57) ABSTRACT

A tank includes: a liquid chamber; an air introduction inlet; a liquid inlet; a liquid outlet; a liquid communication path; a filter; and an exterior wall forming the liquid chamber and including: an upper wall; a bottom wall; a first side wall; and a second side wall positioned farther away from a liquid ejection head than the first side wall is in the in-use state. The liquid communication path has: a first liquid communication path on an outer surface side of the bottom wall; and a second liquid communication path provided on an outer surface side of the first side wall and communicating with the first liquid communication path. The liquid outlet and the filter are positioned at an end part of the first liquid communication path near the second side wall. The liquid outlet is positioned in the liquid communication path near the upper wall.

8 Claims, 11 Drawing Sheets

TIPPED-OVER STATE

TANK AND LIQUID EJECTION DEVICE

BACKGROUND

1. Technical Field

The present invention relates to a tank used in a liquid ejection device.

2. Related Art

Various types of liquid ejection devices that eject liquid, such as ink, have been proposed. Such a liquid ejection device includes a liquid ejection head, a tank containing liquid, and a tube connecting the liquid ejection head to the tank and supplying the liquid from the tank to the liquid ejection head. As an example, WO/2014/115506 discloses a printer used as a liquid ejection device included in a multifunctional apparatus. A tank provided for the printer disclosed in WO/2014/115506 has an ink supply port in the bottom at an end part closer to a print head. This ink supply port is connected, via a supply tube, to a relay unit mounted on a carriage. Then, ink in the tank is supplied to the print head via the supply tube and the relay unit.

When the printer disclosed in WO/2014/115506 is in a normal usage state, the tank is positioned below the print head in the vertical direction. Here, suppose that this state is changed and the tank is positioned above the print head in the vertical direction. In this case, the meniscus of the print head is damaged under an impact, for example, and ink leaks from the print head or the relay unit. In addition, ink in the tank leaks from the print head through the supply tube. These circumstances where the tank is positioned above the print head in the vertical direction in this way can take place when, for example, the top face is confused with the side face and the printer is laid on its side by mistake when transported in a container box, such as a cardboard box. As another example, the tank is positioned above the print head when, after taken out of the container box, the top face is confused with the side face and the printer is placed on its side by mistake.

Such circumstances commonly occur, not only to printers, but also to liquid ejection devices that discharge any liquid. In view of this, a technology of reducing leakage of liquid in the tank from the liquid ejection head is desired.

SUMMARY

An advantage of some aspects of the invention is to solve at least a part of the stated problem and the invention can be implemented as follows.

1. According to an aspect of the invention, a tank is provided which is mounted on a liquid ejection device to supply liquid to a liquid ejection head included in the liquid ejection device. The tank includes: a liquid chamber containing the liquid; an air introduction inlet introducing air into the liquid chamber; a liquid inlet configured to inject the liquid into the liquid chamber; a liquid outlet from which the liquid in the liquid chamber flows out; a liquid communication path causing the liquid from the liquid outlet to pass through the liquid communication path; a liquid supply port configured to supply the liquid in the liquid communication path to the liquid ejection head; a filter removing foreign matter from the liquid; and an exterior wall forming the liquid chamber and including: an upper wall positioned higher in an in-use state in which the liquid is ejected from the liquid ejection head; a bottom wall positioned lower in the in-use state; a first side wall crossing each of the upper wall and the bottom wall; and a second side wall crossing each of the upper wall and the bottom wall and positioned farther away from the liquid ejection head than the first side wall is in the in-use state. The liquid communication path has: a first liquid communication path provided on an outer surface side of the bottom wall; and a second liquid communication path provided on an outer surface side of the first side wall and communicating with the first liquid communication path. Each of the liquid outlet and the filter is positioned at an end part of the first liquid communication path near the second side wall. The liquid supply port is positioned in the liquid communication path near the upper wall.

With the configuration of the tank according to the above aspect, the liquid outlet is positioned at the end part of the first liquid communication path near the second side wall, that is, at the end part near the second side wall located away from the liquid ejection head than the first side wall in the in-use state. Thus, when circumstances cause the tank to be above the liquid ejection head, the liquid outlet is located near the second side wall which is in the upper part of the tank. This configuration can prevent the liquid in the liquid chamber from flowing out of the liquid outlet and thus prevent leakage of the ink in the tank from the liquid ejection head in the liquid ejection device. In addition, suppose that when ink is injected from the liquid inlet, foreign matter enters the ink in the liquid chamber. In this case, the filter provided for the first liquid communication path can prevent the liquid communication path and the liquid ejection head from being clogged with this foreign matter.

2. With the configuration of the tank according to the above aspect, when the liquid chamber is filled with the liquid up to a highest level of a predetermined capacity range and the first side wall is positioned lower in a vertical direction, the liquid outlet may be positioned above a fluid level of the liquid. With this configuration of the tank in the above aspect, when the liquid chamber is filled with the liquid up to the highest fluid level of the predetermined capacity range and the first side wall is positioned lower in the vertical direction, the liquid outlet is positioned above the fluid level of the liquid. Thus, in this state, the liquid in the liquid chamber is more reliably prevented from flowing out of the liquid outlet.

3. With the configuration of the tank according to the above aspect, the liquid chamber may have an opening enclosed by the exterior wall. Moreover, the first liquid communication path may have a first groove provided on the outer surface side of the bottom wall. Furthermore, the second liquid communication path may have a second groove provided on the outer surface side of the first side wall. The tank may further include a film covering the opening, the first groove, and the second groove. With this configuration of the tank in the above aspect, one side of the liquid chamber, one side of the first liquid communication path, and one side of the second liquid communication path can be formed to share one and the same film. This configuration can reduce the manufacturing cost and time of the tank. Furthermore, the exterior wall, which is included in the liquid chamber, is a part of the wall forming the liquid communication path. Thus, as compared with the case where the exterior wall and the liquid communication path are formed separately, the tank can be reduced in size and manufactured in a shorter time as well.

4. With the configuration of the tank according to the above aspect, the liquid chamber may have an air release hole that communicates with the air introducing inlet. The air release hole may be positioned above a fluid level of the liquid when the liquid chamber is filled with the liquid up to a highest level of a predetermined capacity range and the first side wall is positioned lower in a vertical direction. With this configuration of the tank in the above aspect, when the liquid chamber is filled with the liquid up to the highest fluid level of the predetermined capacity range and the first side wall is positioned lower in the vertical direction, the air release hole is positioned above the fluid level of the liquid. Thus, in this state, the liquid in the liquid chamber is more reliably prevented from flowing into the air release hole and flowing out of the air introducing inlet.

The invention can be implemented through various aspects. For example, the invention can be implemented by a liquid ejection device including the tank and the liquid ejection head according to any one of the above aspects. Moreover, the invention can be implemented by a method of manufacturing a tank or a method of manufacturing a liquid ejection device, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

A-1. Overall Configuration of Complex Apparatus 10

Figure 1:
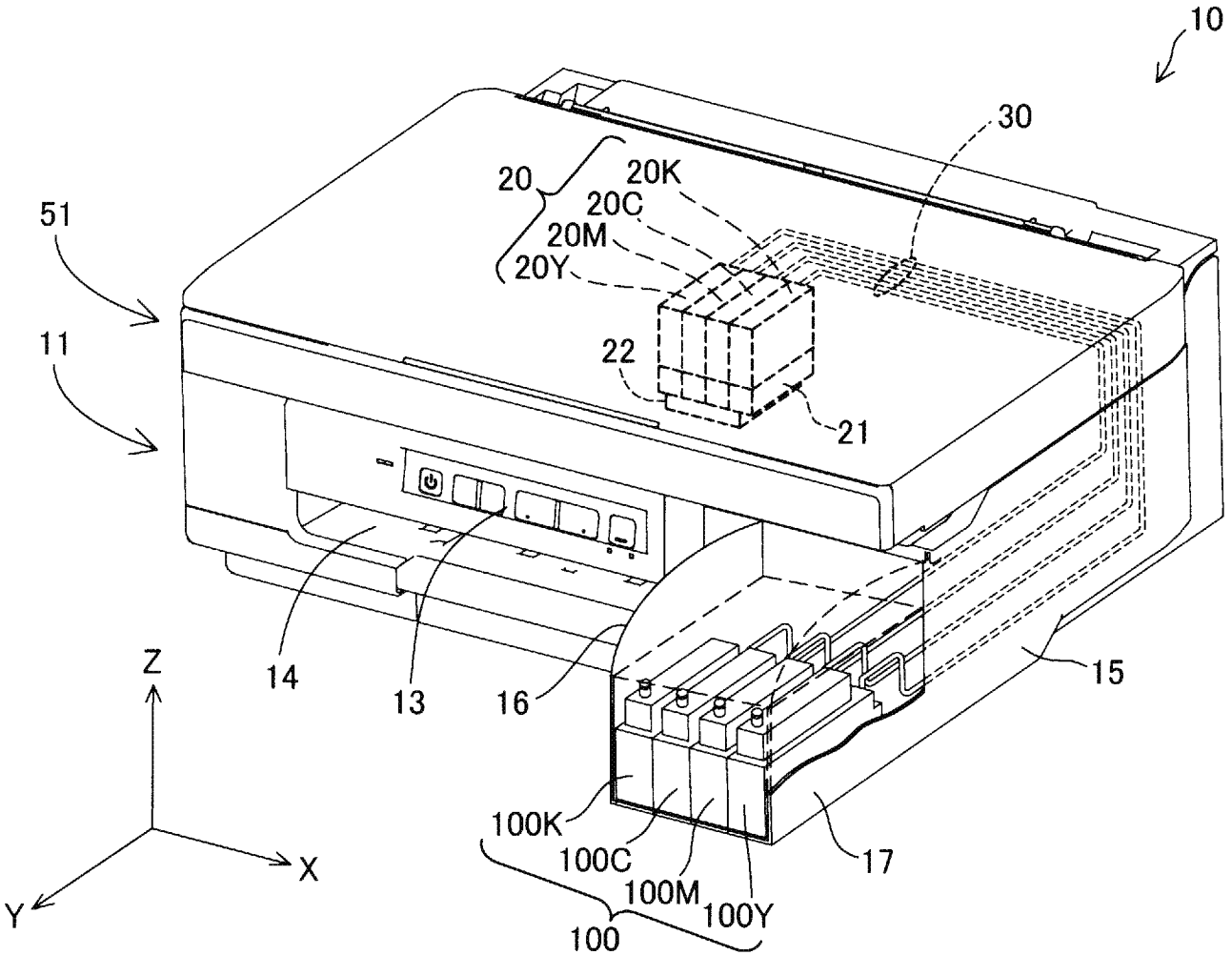
FIG. 1 is an external perspective view of a configuration of a multifunctional apparatus that includes a tank according to an embodiment of the invention.

FIG. 1 is an external perspective view of a configuration of a multifunctional apparatus 10 that includes a tank 100 according to an embodiment of the invention. The multifunctional apparatus 10 includes a scanner unit 51 and a printer 11. The scanner unit 51 and the printer 11 are mounted on each other in a stacking manner in the multifunctional apparatus 10. In the present embodiment, the printer 11 is a so-called inkjet printer. The printer 11 ejects ink from a print head 22 to print, for example, an image onto a medium, such as a sheet of printing paper. The print head 22 is described later. The multifunctional apparatus 10 is placed on, for example, a desk or a table such that the scanner unit 51 is positioned above the printer 11 in the vertical direction in a state where the printer 11 ejects ink (hereinafter, this state is referred to as the "in-use state"). FIG. 1 shows X, Y, and Z axes that are coordinate axes orthogonal to each other. The X-Y plane is parallel to the horizontal plane. The +Z direction refers to the vertically upward direction, and the −Z direction refers to the vertically downward direction. In the embodiment, the +Z and −Z directions are also collectively referred to as the Z axis direction. Similarly, the +X and −X directions are also collectively referred to as the X axis direction, and the +Y and −Y directions are also collectively referred to as the Y axis direction. It should be noted that the X, Y, Z axes directions in FIG. 2 and the subsequent drawings indicate the same directions as those indicated by the X, Y, Z axes directions in FIG. 1. The printer 11 corresponds to a subordinate concept of the liquid ejection device described in SUMMARY above.

The scanner unit 51 is a so-called flatbed scanner and includes an imaging element (not shown), a platen, and a cover. For example, the imaging element may be an image sensor. The scanner unit 51 images letters or images recorded on a medium, such as a sheet of paper, using the imaging element and reads the letters or images as image data. The scanner unit 51 has a rotation axis along the X axis direction at an end part in the −Y direction, and is configured to be rotatable about the rotation axis. A surface of the platen (not shown) of the scanner unit 51 on the side near the printer 11 (i.e., the surface in the −Z direction) covers a housing 15 and also functions as a cover of the printer 11.

The printer 11 includes: the housing 15; four tanks 100K, 100C, 100M, and 100Y; a carriage 21; four relay units 20K, 20C, 20M, and 20Y; a print head 22; a tube 30; an operation panel 13; and a paper discharge port 14.

The housing 15 is an outer shell of the printer 11. The housing 15 houses the four tanks 100K, 100C, 100M, and 100Y, the carriage 21, the four relay units 20K, 20C, 20M, and 20Y, the print head 22, and the tube 30. In the embodiment, the four tanks 100K, 100C, 100M, and 100Y may also be referred to collectively as the "tanks 100" or individually as the "tank 100". Similarly, the four relay units 20K, 20C, 20M, and 20Y may also be referred to collectively as the "relay units 20" or individually as the "relay unit 20". Note that FIG. 1 shows a partially cut-away view of the housing 15 to present a partially seen-through view.

In addition to the four tanks 100 and so forth described above, the housing 15 further houses a controller (not shown), a carrying mechanism (not shown), and a transport mechanism (not shown). The controller controls the ink ejection timing, the amount of ejection, and the transport amount of printing paper. The carrying mechanism causes the carriage 21 to reciprocate back and forth (perform scanning). The transport mechanism transports printing paper. The housing 15 is provided with a tank holder 17. In the in-use state, the tank holder 17 is positioned on the front side in the multifunctional apparatus 10 (in the +Y direction) and protrudes in the +Y direction as compared with the other parts of the housing 15. The tank holder 17 holds the four tanks 100 aligned along the X axis direction. The tank container 17 has an opening in the top. This opening is covered by a cover 16 to be openable and closable. The cover 16 is rotatable in the same direction in which the scanner unit 51 is rotatable. As described later, each of the tanks 100 is configured to be refillable with ink. A user can turn the cover 16 to expose the tanks 100 and then refill a desired one of the tanks 100 with ink.

Each of the tanks 100 contains a different color of ink. To be more specific, the tank 100K contains black ink. Moreover, the tank 100C contains cyan ink, the tank 100M contains magenta ink, and the tank 100Y contains yellow ink. The tank 100K is connected to the relay unit 20K via the tube 30 and supplies black ink to the relay unit 20K. The tank 100C is connected to the relay unit 20C via the tube 30 and supplies cyan ink to the relay unit 20C. The tank 100M is connected to the relay unit 20M via the tube 30 and supplies magenta ink to the relay unit 20M. The tank 100Y is connected to the relay unit 20Y via the tube 30 and supplies yellow ink to the relay unit 20Y. The detailed configuration of the tank 100 is described later. The tube 30 includes a total of four tubes each of which is made of a flexible material, such as synthetic rubber.

The carriage 21 is reciprocatable back and forth along the X axis direction inside the housing 15. The four relay units 20 and the print head 22 are mounted on the carriage 21. The carrying mechanism (not shown) causes the carriage 21 to reciprocate back and forth along the X axis direction. Thus, the scanning direction of the carriage 21 and the print head 22 is parallel to the X axis direction. In the embodiment, the carriage 21 and the print head 22 perform scanning on the rear side (in the −Y direction) with respect to the tanks 100 as shown in FIG. 1.

The print head 22 is positioned to be able to eject ink in the vertically downward direction, below the carriage 21 in the vertical direction. The print head 22 has a number of nozzles (not shown). While the carriage 21 is reciprocating back and forth, ink is ejected from the print head 22 to form, for example, an image onto a medium, such as printing paper. The printing paper on which the image, for example, is formed is discharged from the paper discharge port 14. The print head 22 corresponds to a subordinate concept of the liquid ejection head described in SUMMARY above.

The relay units 20 are aligned in the carriage 21 along the X axis direction. Each of the relay units 20 is connected to the corresponding one of the tanks 100 via the tube 30. Moreover, each of the relay units 20 is connected to the print head 22. Each of the relay units 20 temporarily retain the ink supplied from the corresponding one of the tanks 100 and supplies the ink to the print head 22 in accordance with ink ejection from the print head 22.

The operation panel 13 is positioned on the front side in the multifunctional apparatus 10 (in the +Y direction) in the in-use state. The operation panel 13 has a power button and other operation buttons. The user of the multifunctional apparatus 10 can operate the various operation buttons, facing the operation panel 13.

A-2. Detailed Configuration of Tank

Figure 2:
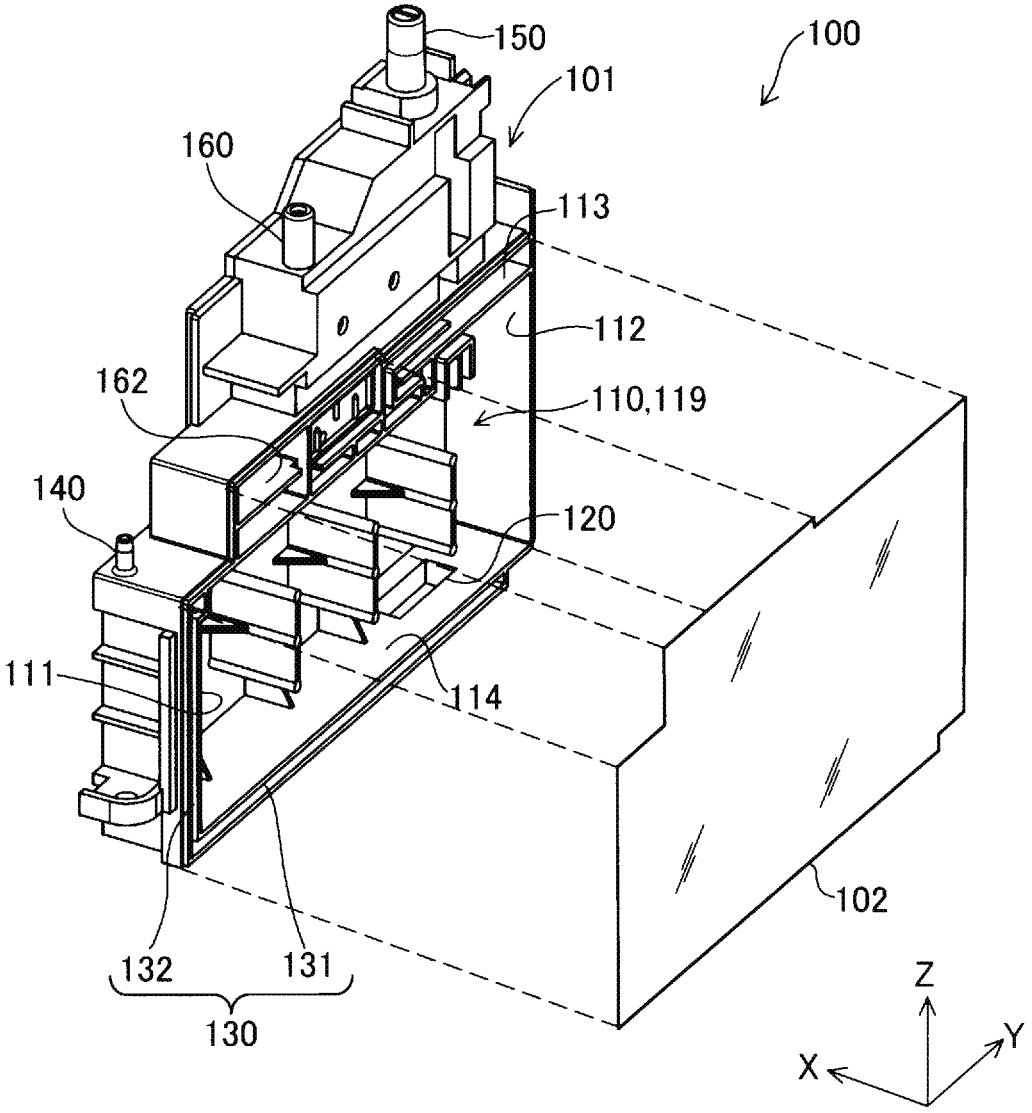
FIG. 2 is a first perspective view of the tank.
Figure 3:
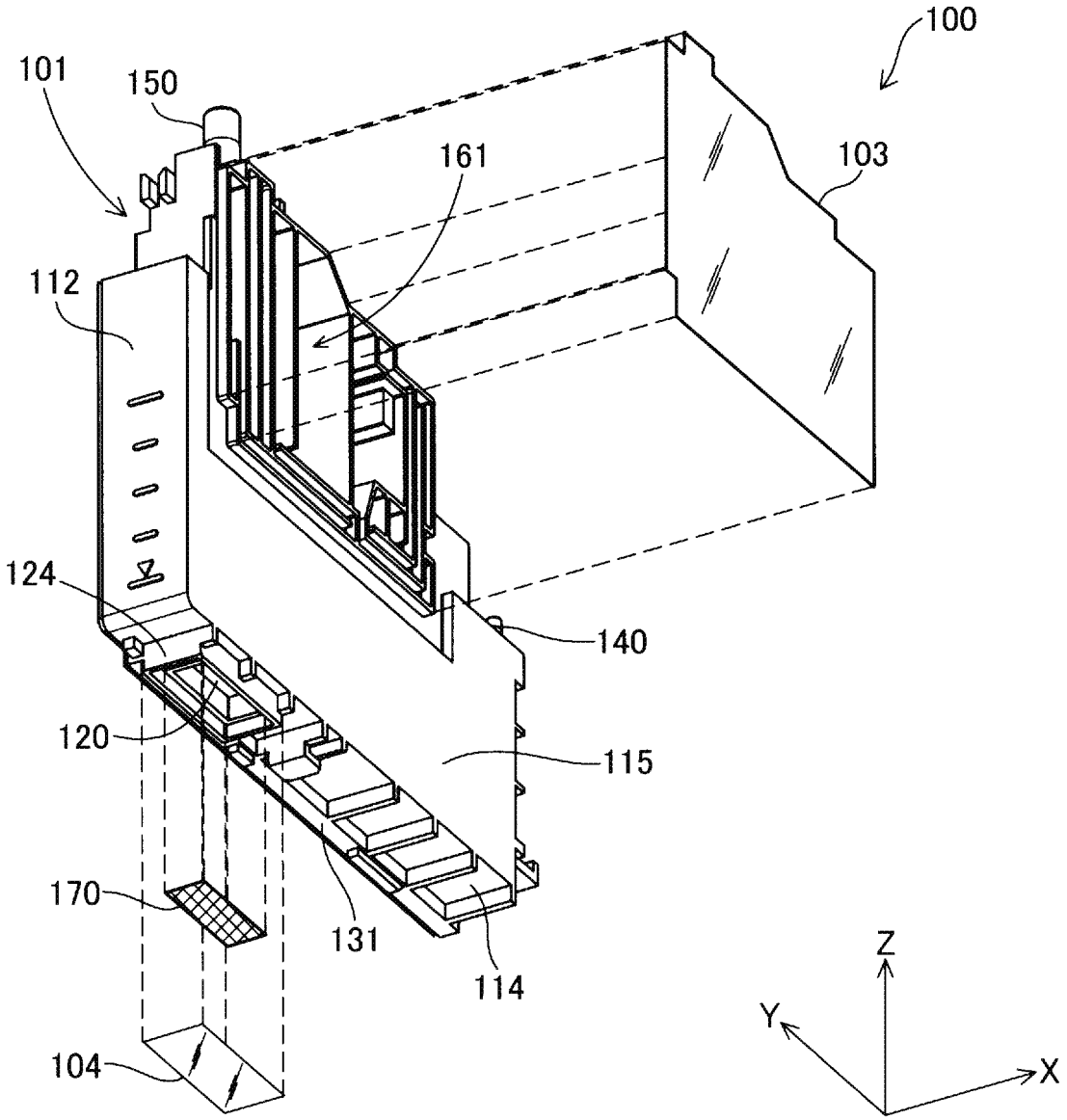
FIG. 3 is a second perspective view of the tank.
Figure 4:
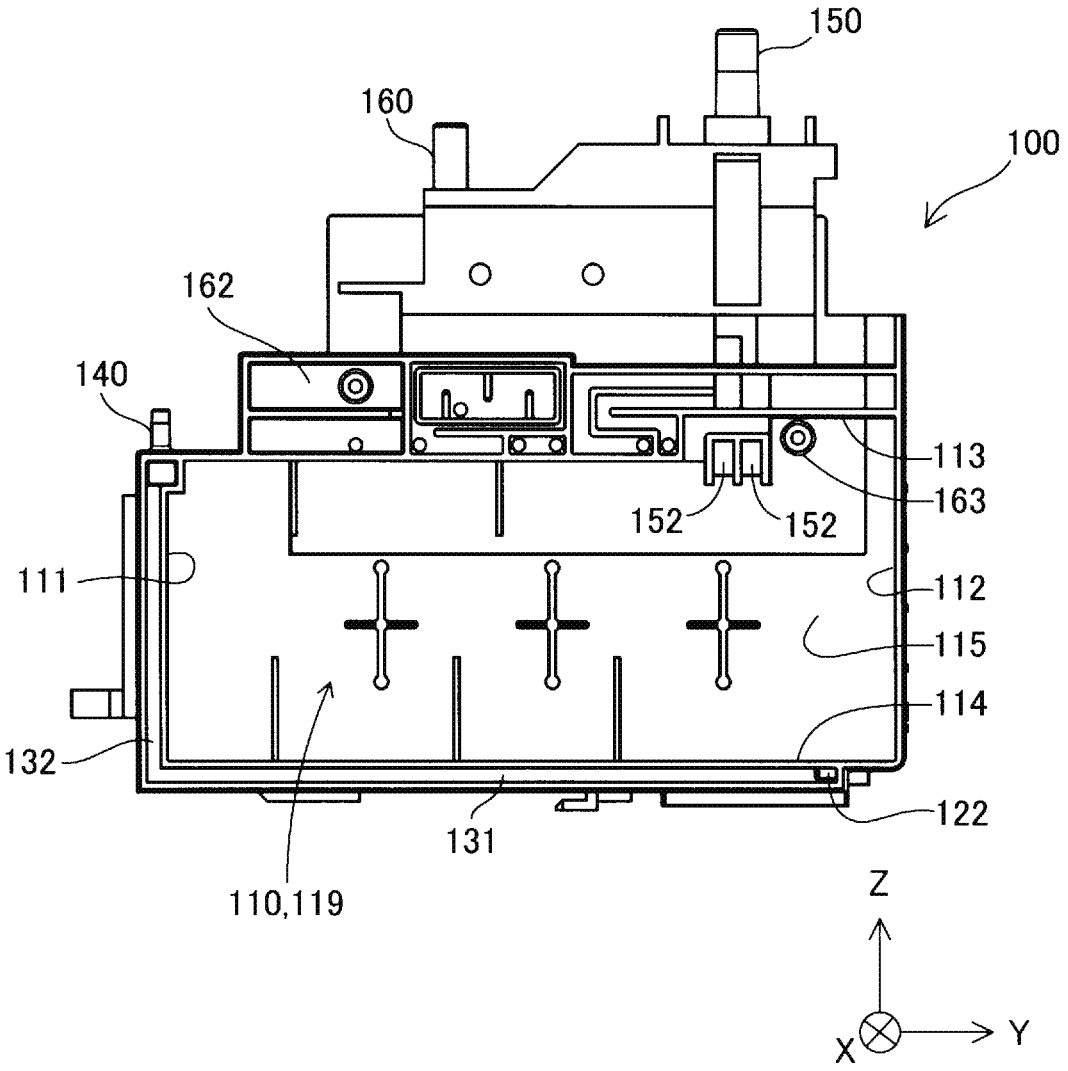
FIG. 4 is a first side elevation view of the tank.
Figure 5:
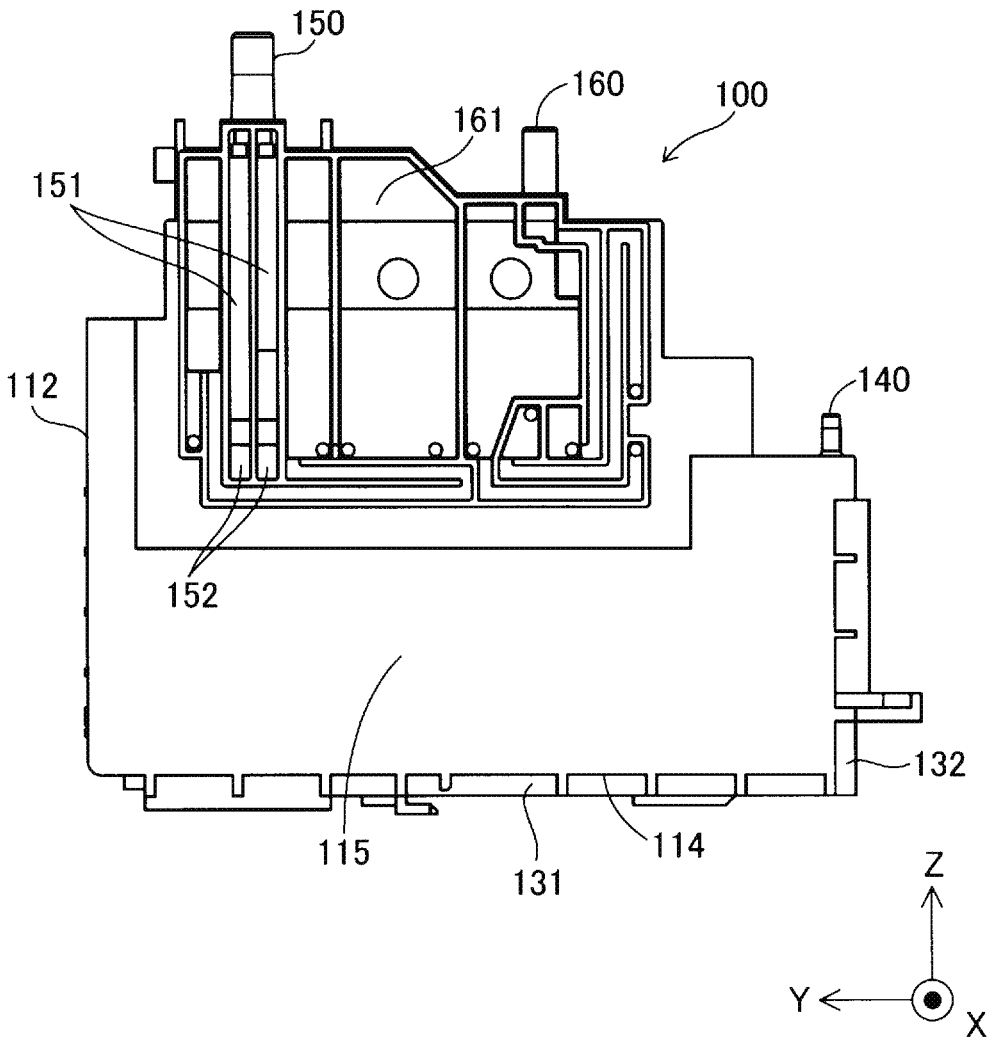
FIG. 5 is a second side elevation view of the tank.
Figure 6:
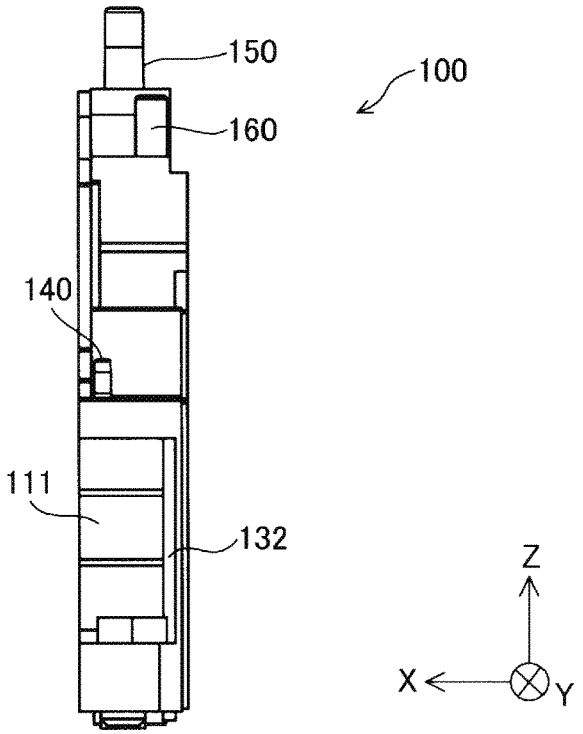
FIG. 6 is a rear elevation view of the tank.
Figure 7:
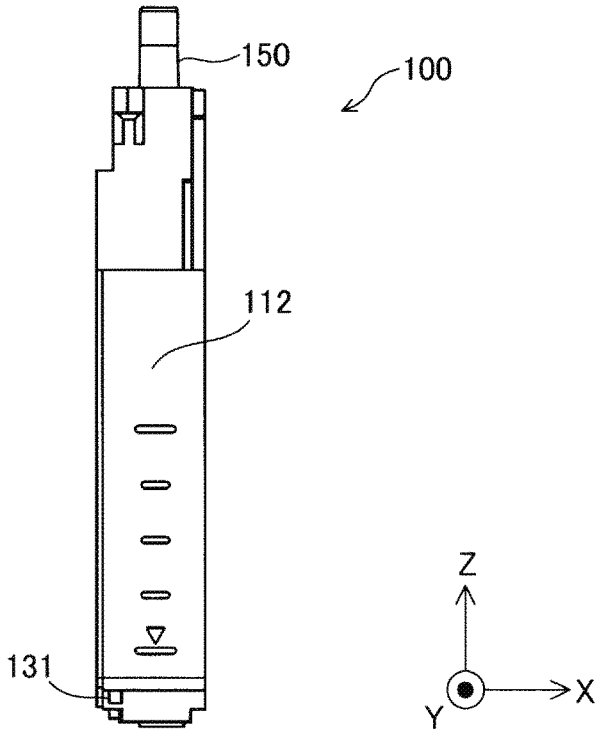
FIG. 7 is a front elevation view of the tank.
Figure 8:
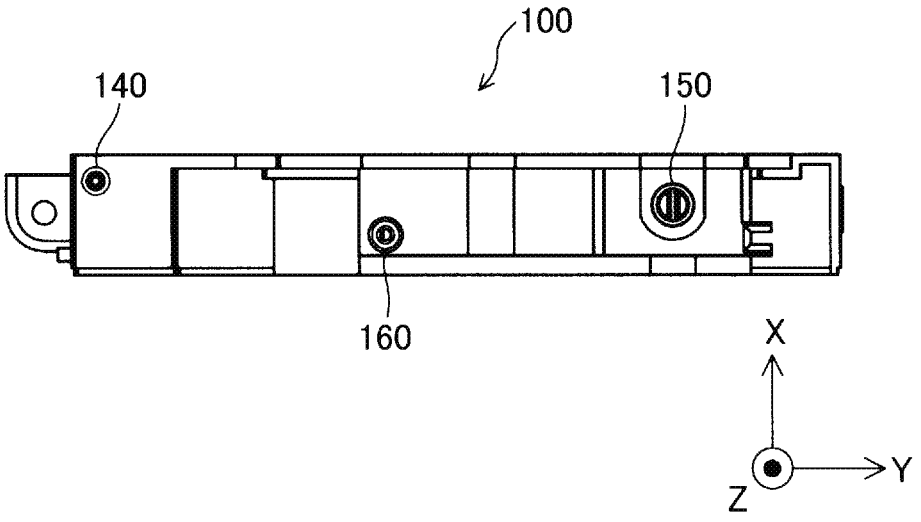
FIG. 8 is a top view of the tank.
Figure 9:
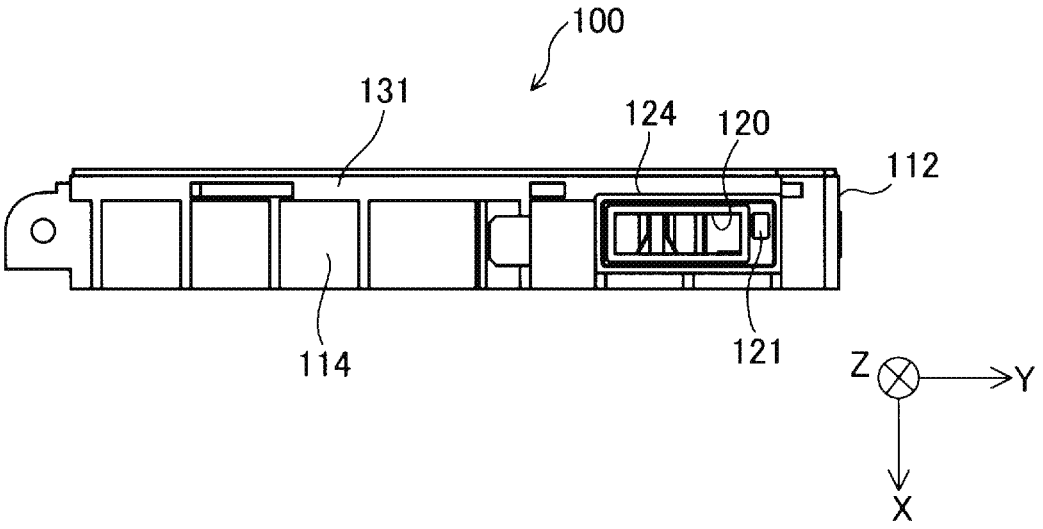
FIG. 9 is a bottom view of the tank.

FIG. 2 is a first perspective view of the tank 100. FIG. 3 is a second perspective view of the tank 100. FIG. 4 is a first side elevation view of the tank 100. FIG. 5 is a second elevation view of the tank 100. FIG. 6 is a rear elevation view of the tank 100. FIG. 7 is a front elevation view of the tank 100. FIG. 8 is a top view of the tank 100. FIG. 9 is a bottom view of the tank 100. As shown in FIG. 1, the side positioned in the +Y direction in the in-use state corresponds to the front of the tank 100. In this state, the side positioned in the −Y direction corresponds to the rear of the tank 100.

As shown in FIG. 2 and FIG. 3, the tank 100 includes a case 101, a first sheet member 102, a second sheet member 103, a third sheet member 104, and a filter 170.

The case 101 is made of synthetic resin, such as nylon or polypropylene. The case 101 includes a liquid inlet 150, an air introduction inlet 160, and a liquid supply port 140. As shown in FIG. 2, the case 101 has an opening exposed in the −X direction. Moreover, as shown in FIG. 3, the case 101 has an opening exposed in the +X direction and an opening exposed in the −Z direction. Inside these openings, a number of grooves and a rib-like structure are formed. To cover these openings, the first sheet member 102, the second sheet member 103, and the third sheet member 104 are disposed. Edge parts of the first to third sheet members 102 to 104 are welded to edge parts of the openings. This welding allows various chambers and paths to be formed inside the tank 100. To be more specific, the tank 100 has a liquid chamber 110, a gas-liquid replacement channel 151, a first air communication section 161, a second air communication section 162, and a liquid communication path 130. Each of the second to third sheet members 102 to 104 is a film made of synthetic resin and has flexibility. As the synthetic resin, nylon or polypropylene may be adopted, for example.

The liquid chamber 110 contains ink. As shown in FIG. 2, the liquid chamber 110 is configured with an exterior wall 119 and the first sheet member 102. As shown in FIG. 2 to FIG. 9, the exterior wall 119 includes an upper wall 113, a bottom wall 114, a first side wall 111, a second side wall 112, and a third side wall 115.

As shown in FIG. 2 to FIG. 7, the upper wall 113 is positioned at an end part of the exterior wall 119 in the +Z direction in the in-use state. The second air communication section 162 is positioned above the upper wall 113. Thus, the upper wall 113 is not exposed to the outside.

As shown in FIG. 3 to FIG. 5, the bottom wall 114 is positioned at an end part of the exterior wall 119 in the −Z direction in the in-use state. Thus, the upper wall 113 and the bottom wall 114 are positioned to oppose each other, with ink in the liquid chamber 110 in between. Below (in the −Z direction) a part closer to an end part of the bottom wall 114 in the −X direction, the liquid communication path 130 (a first liquid communication path 131 described later) is positioned. Thus, this part of the bottom wall 114 is not exposed to the outside.

As shown in FIG. 9, a liquid outlet 120 is formed in the bottom wall 114. The liquid outlet 120 is a through hole formed in the thickness direction (the Z axis direction) of the bottom wall 114. The liquid outlet 120 is a rectangle in plan view. From the liquid outlet 120, the ink in the liquid chamber 110 flows out.

Figure 10:
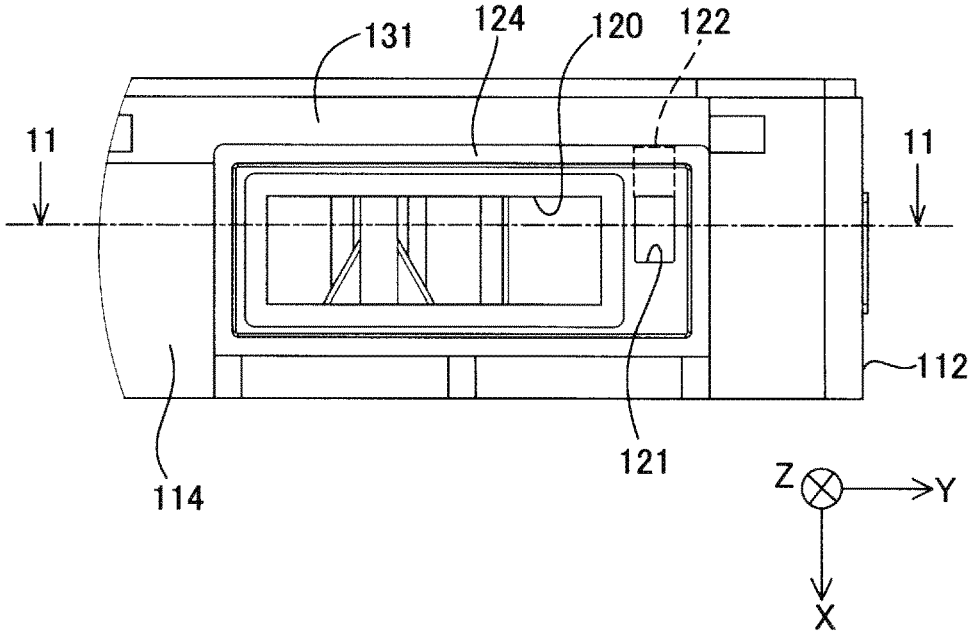
FIG. 10 is an enlarged diagram illustrating a region around a liquid outlet in a bottom wall.

FIG. 10 is an enlarged diagram illustrating a region around the liquid outlet 120 in the bottom wall 114. As shown in FIG. 9 and FIG. 10, an aperture 121 is positioned in the +Y direction with respect to the liquid outlet 120. The aperture 121 communicates with the liquid communication path 130 (with an aperture 122 of the first liquid communication path 131 described later).

As shown in FIG. 3, the filter 170 is disposed to cover the liquid outlet 120 from the −Z direction. The filter 170 removes foreign matter from ink flowing out of the liquid outlet 120. A protrusion 124 is formed to encompass the liquid outlet 120 and protrude in the −Z direction. The third sheet member 104 has nearly the same shape as the protrusion 124 in plan view. The third sheet member 104 is formed to cover the protrusion 124 from the −Z direction and welded to an edge part of the protrusion 124 in the −Z direction. This welding can reduce outside leakage of ink flowing from the liquid outlet 120 and passing through the filter 170.

As shown in FIG. 2 and FIG. 4, the first side wall 111 is positioned at an end part of the exterior wall 119 on the rear side (in the −Y direction), in the in-use state. The first side wall 111 intersects with the upper wall 113 and the bottom wall 114. In the embodiment, when two walls "intersect" with each other, this means that the end parts of the two walls contact each other and that virtually extended walls of these two walls intersect with each other. On the rear side (in the −Y direction) of a part closer an end part of the first side wall 111 in the −X direction, the liquid communication path 130 (a second liquid communication path 132 described later) is positioned. Thus, this part of the first side wall 111 is not exposed to the outside.

As shown in FIG. 2 to FIG. 4, the second side wall 112 is positioned at an end part of the exterior wall 119 on the front side (in the +Y direction) in the in-use state and thus exposed to the outside. As with the first side wall 111, the second side wall 112 intersects with the upper wall 113 and the bottom wall 114. The first side wall 111 and the second side wall 112 are positioned to oppose each other, with ink in the liquid chamber 110 in between. As can be seen from FIG. 1, the second side wall 112 is positioned farther away from the print head 22 than the first side wall 111 is in the in-use state, in the embodiment.

The liquid inlet 150 is used for injecting ink into the liquid chamber 110. As shown in FIG. 2 and in FIG. 4 to FIG. 6, the liquid inlet 150 protrudes in the +Z direction at an end part of the tank 100 in the +Z direction on the front side (in the +Y direction). When the amount of ink in the tank 100 decreases, the user can refill the liquid chamber 110 by connecting an ink-filled bottle (not shown) to the liquid inlet 150. As shown in FIG. 5, the liquid inlet 150 communicates with the gas-liquid replacement channel 151. The gas-liquid replacement channel 151 replaces gas in the liquid chamber 110 with ink injected from the liquid inlet 150. The gas-liquid replacement channel 151 has two channels extending in the Z axis direction. An end part of the gas-liquid replacement channel 151 in the +Z direction communicates with the liquid inlet 150, and an end part of the gas-liquid replacement channel 151 in the −Z direction communicates with an opening 152 formed in the liquid chamber 110. When ink is injected from the liquid inlet 150 into the liquid chamber 110, one of the two channels of the gas-liquid replacement channel 151 leads ink into the liquid chamber 110 and the other channel discharges gas of the liquid chamber 110 to the outside (into the bottle not shown). When the ink refilling progresses and then the fluid level of ink covers the opening 152, this means that further refilling cannot be performed because gas in the liquid chamber 110 cannot be replaced with ink anymore.

The air introduction inlet 160 is used for introducing air into the liquid chamber 110. As shown in FIG. 2 and in FIG. 4 to FIG. 6, the air introduction inlet 160 protrudes in the +Z direction at the end part of the tank 100 in the +Z direction and is positioned nearly in the center of the tank 100 in the Y axis direction.

As shown in FIG. 3 and FIG. 5, the first air communication section 161 is configured with: the opening included in the case 101 and exposed in the +X direction; and the second sheet member 103. As show in FIG. 2 and FIG. 4, the second air communication section 162 is configured with: the opening included in the case 101 and exposed in the −X direction; and the first sheet member 102. As shown information FIG. 4 and FIG. 5, the case 101 includes a plurality of through holes formed in the thickness direction (the X axis direction) to allow the first air communication section 161 and the second air communication section 162 to communicate with each other. Moreover, the case 101 includes an air release hole 163. The air release hole 163 is a through hole formed in the thickness direction to allow the first air communication section 161 and the liquid chamber 110 to communicate with each other. With this configuration, air introduced from the air introduction inlet 160 is supplied into the liquid chamber 110 via the first air communication section 161, the second air communication section 162, the plurality of through holes, and the air release hole 163. In the embodiment, a path for introducing air that includes the air introduction inlet 160, the first air communication section 161, the second air communication section 162, the plurality of through holes, and the air release hole 163 is also referred to as the "air introduction path". Each of the first air communication section 161 and the second air communication section 162 has channels bending upward, downward, forward, and backward intricately in the in-use state, and also has a chamber for temporarily retaining ink. When ink in the liquid chamber 110 flows from the air release hole 163 to the air introduction path, this chamber temporarily retains this inflow ink and prevents this inflow ink from flowing to the outside of the tank 100.

The liquid supply port 140 corresponds to an outlet of ink flowing from the tank 100 to the outside. The liquid supply port 140 is inserted into the tube 30 and supplies ink of the liquid chamber 110 to the tube 30. As shown in FIG. 4, the liquid supply port 140 protrudes in the +Z direction at the end part of the tank 100 in the +Z direction on the rear side (in the −Y direction). The liquid supply port 140 communicates with one end of the liquid communication path 130.

The liquid communication path 130 allows the ink from the liquid outlet 120 to pass through the liquid communication path 130. As shown in FIG. 2 and FIG. 4, the liquid communication path 130 includes the first liquid communication path 131 and the second liquid communication path 132.

As shown in FIG. 2 and FIG. 4, the first liquid communication path 131 is positioned on the outer surface side (in the −Z direction) of the bottom wall 114. To be more specific, as shown in FIG. 9, the first liquid communication path 131 is formed along the Y axis direction at the end part of the bottom wall 114 in the −X direction. As shown in FIG. 4, the aperture 122 is provided an end part of the first liquid communication path 131 in the +Y direction. As shown in FIG. 10, the aperture 122 communicates with the aperture 121 positioned near the liquid outlet 120 and described above.

Figure 11:
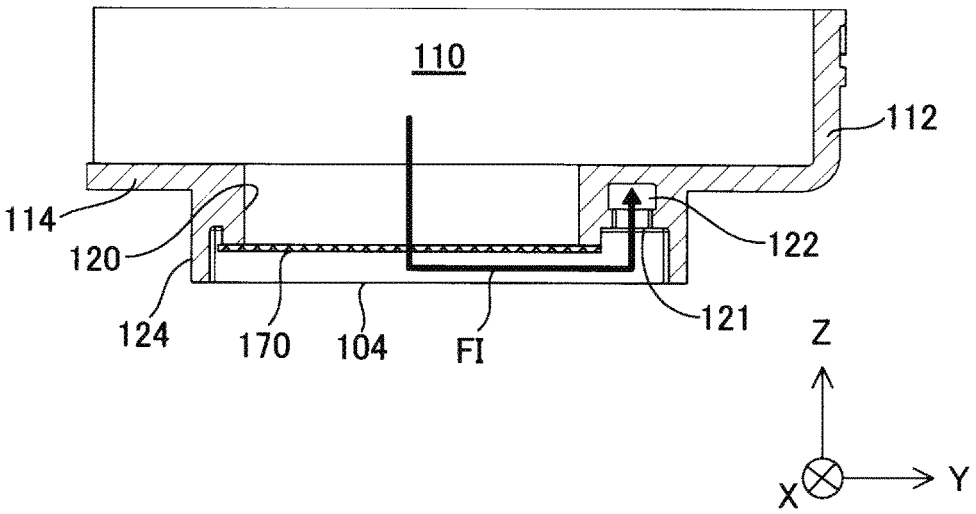
FIG. 11 is a cross-sectional view taken along line 11-11 of FIG. 10.

FIG. 11 is a cross-sectional view taken along line 11-11 of FIG. 10. In FIG. 10, a part of an ink flow FI from the liquid chamber 110 is indicated by a thick arrow. The ink in the liquid chamber 110 flows from the liquid outlet 120 to pass through the filter 170. Then, the ink passes through a region enclosed with the protrusion 124 and the third sheet member 104 to reach the aperture 121. The aperture 121 communicates with the aperture 122 as described above. Thus, the ink flowing into the aperture 121 flows from the aperture 122 to the first liquid communication path 131. Here, note that an ink path from the liquid outlet 120 to the aperture 122 is a part of the first liquid communication path 131.

As shown in FIG. 2 and FIG. 4, an end part of the first liquid communication path 131 in the −Y direction communicates with an end part of the first liquid communication path 131 in the −Z direction. The second liquid communication path 132 is positioned on the outer surface side (in the −Y direction) of the first side wall 111. To be more specific, as shown in FIG. 6, the second liquid communication path 132 is formed along the Z axis direction at the end part of the first side wall 111 in the −X direction. As shown in FIG. 4, one of the two end parts of the second liquid communication path 132 that does not communicate with the first liquid communication path 131 communicates with the liquid supply port 140. Thus, the ink flowing from the liquid outlet 120 to the first liquid communication path 131 passes through the second liquid communication path 132 to be discharged to the liquid supply port 140.

As shown in FIG. 2 and FIG. 4, the first liquid communication path 131 has a groove (hereinafter, also referred to as the "first groove") provided on the outer surface side of the bottom wall 114 to have a depth in the +X direction and elongated along the Y axis direction. Moreover, the second liquid communication path 132 has a groove (hereinafter, also referred to as the "second groove") provided on the outer surface side of the first side wall 111 to have a depth in the +X direction and formed along the X axis direction. With the first groove and the second groove being covered with the first sheet member 102, the first liquid communication path 131 and the second liquid communication path 132 are formed. This configuration allows one side of the first liquid communication path 131 and one side of the second liquid communication path 132 to be formed to share one and the same member, that is, the first sheet member 102. With this configuration, the manufacturing cost and time of the tank 100 can be thus reduced. Moreover, the bottom wall 114 in the −Z direction is a part of a wall forming the first liquid communication path 131. Furthermore, the first side wall 111 in the −Y direction is a part of a wall forming the second liquid communication path 132. Thus, as compared with the case where the bottom wall 114 and the upper wall 113 are formed separately and the first side wall 111 and the second liquid communication path 132 are formed separately, the tank 100 can be reduced in size and manufactured in a shorter time as well.

Figure 12:
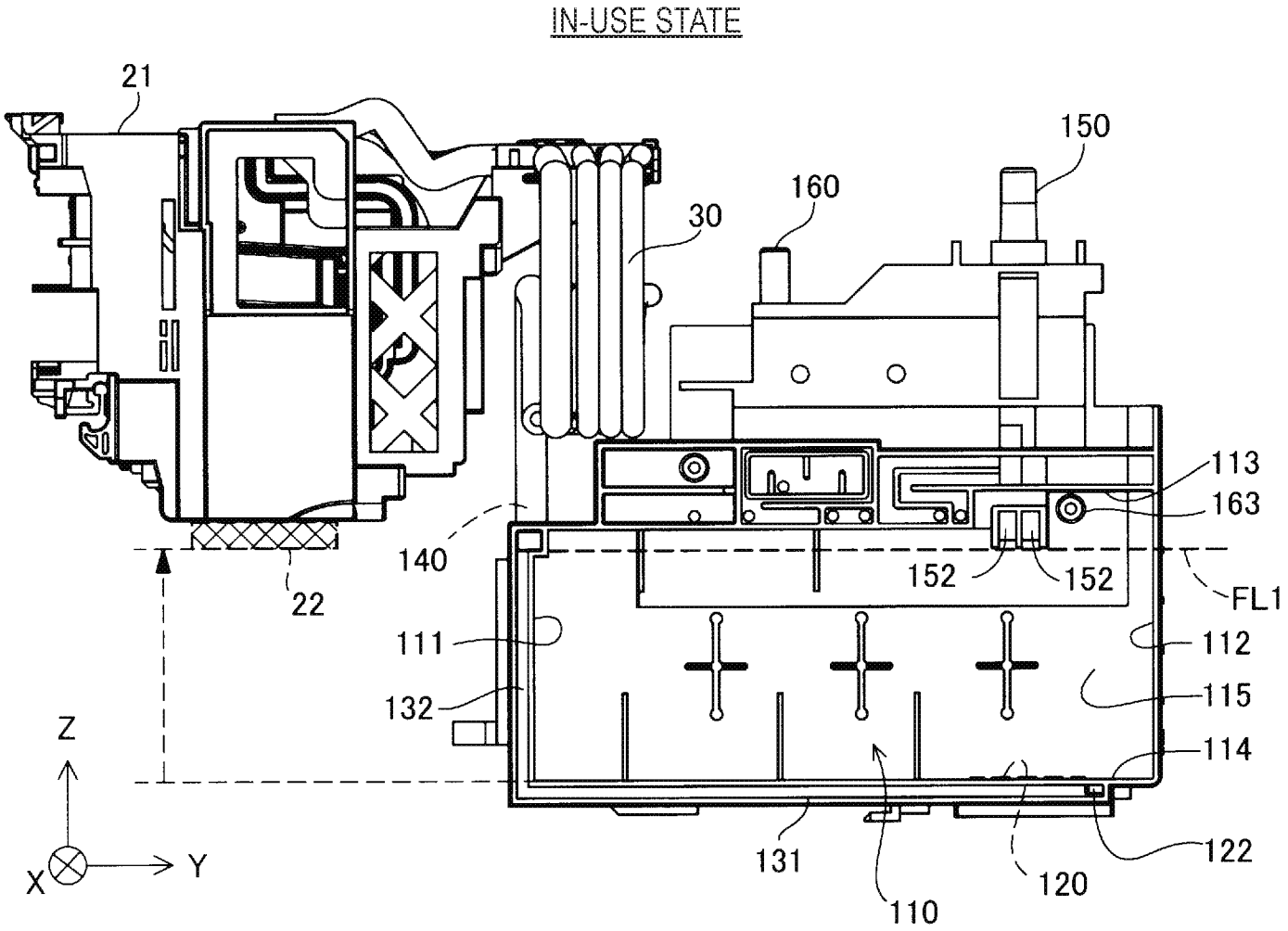
FIG. 12 is a diagram illustrating a positional relationship between the tank and a print head in an in-use state.

A-3. Positional Relationship Between Tank 100 and Print Head 22 in In-Use State FIG. 12 is a diagram illustrating a positional relationship between the tank 100 and the print head 22 in the in-use state. In FIG. 12, the shape of the tube 30 is schematically illustrated. Moreover, the liquid outlet 120 is indicated by a dashed line for convenience. Furthermore, in FIG. 12, illustration of the relay units 20 is omitted and the print head 22 is schematically indicated by a dashed line, for the sake of simplicity.

FIG. 12 shows a state in which the liquid chamber 110 is filled with ink up to a highest fluid level FL1 of a predetermined capacity range. In the embodiment, the highest fluid level FL1 is predetermined as being a plane parallel to the X-Y plane passing through the lower end of the opening 152. As described above, when the fluid level of ink covers the opening 152, further refilling cannot be performed because gas in the liquid chamber 110 cannot be replaced with ink anymore. For this reason, the plane parallel to the X-Y plane passing through the lower end of the opening 152 is predetermined as being the highest fluid level FL1 in the embodiment.

As shown in FIG. 12, the print head 22 is positioned above the liquid outlet 120 in the vertical direction in the in-use state. Here, suppose that the meniscus of the print head 22 is damaged due to an impact upon the printer 11 while no ink is being ejected in the in-use state. Even in this case, the hydraulic head pressure prevents the ink in the liquid chamber 110 from flowing out of the print head 22.

Figure 13:
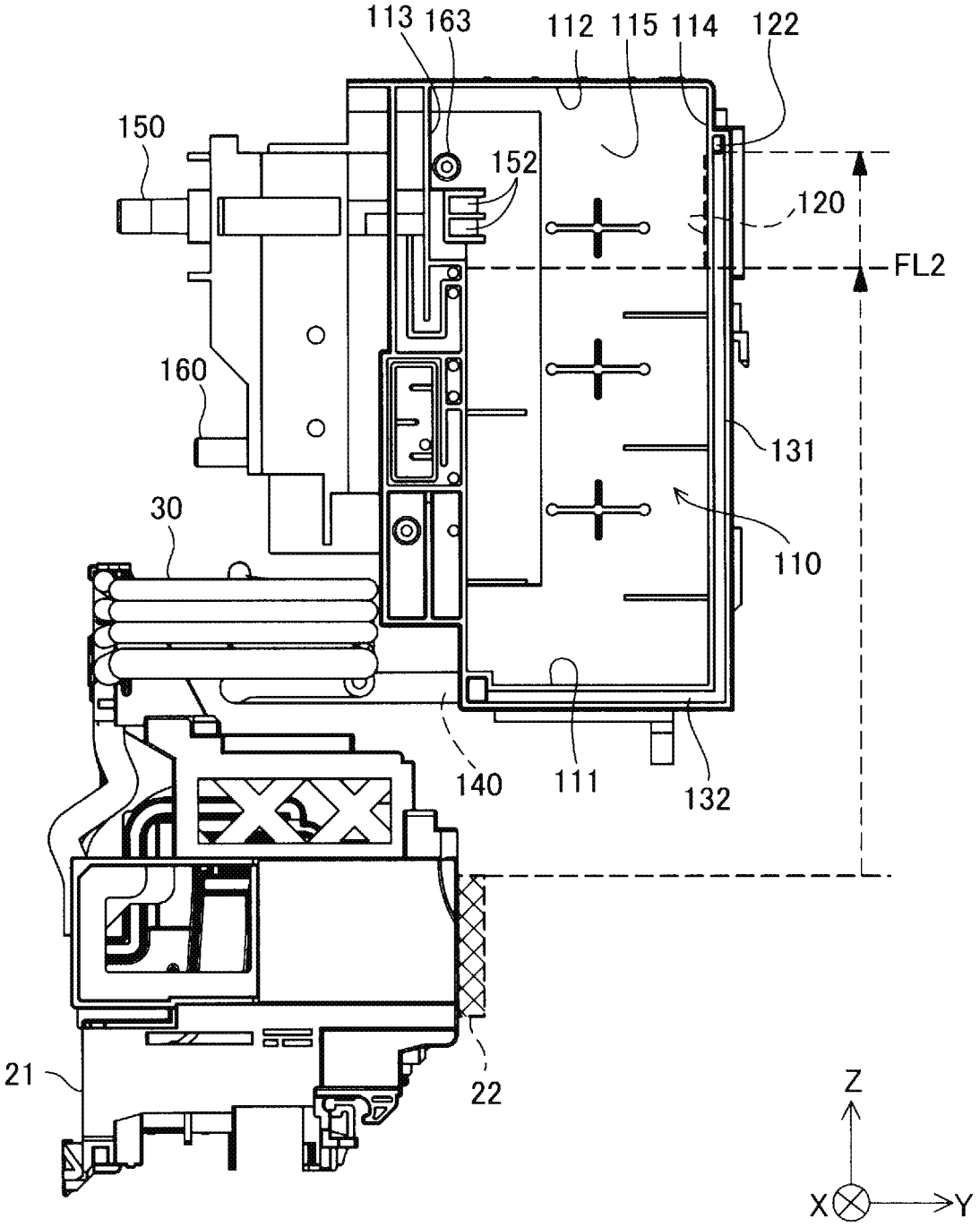
FIG. 13 is a diagram illustrating a positional relationship between the tank and the print head in a tipped-over state.

A-4. Positional Relationship Between Tank 100 and Print Head 22 in Tipped-Over State FIG. 13 is a diagram illustrating a positional relationship between the tank 100 and the print head 22 when the printer 11 is tipped over to be placed (hereinafter, this state of the printer 11 is referred to as the "tipped-over state"). In FIG. 13, the shape of the tube 30 is schematically illustrated as in FIG. 12. Moreover, the liquid outlet 120 is indicated by a dashed line for convenience.

In the tipped-over state shown in FIG. 13, the carriage 21 and the print head 22 are positioned below the tank 100 in the vertical direction. Such a tipped-over state can occur when, for example, the multifunctional apparatus 10 is placed for transportation in a container box, such as a cardboard box, with the rear side of the multifunctional apparatus 10 being positioned lower in the vertical direction. Note that FIG. 13 shows the case where the printer 11 is tipped over with the ink being filled up to the highest fluid level FL1 as shown in FIG. 12.

In this tipped-over state, a fluid level FL2 of the ink in the liquid chamber 110 is above the print head 22 in the vertical direction. In this state, even when the meniscus of the print head 22 is damaged, the ink in the liquid chamber 110 is prevented from flowing out of the print head 22. This is because the liquid outlet 120 is positioned in an upper part of the tank 100 in the vertical direction and, in this state, the ink in the liquid chamber 110 does not flow out of the liquid outlet 120. According to the embodiment in particular, when the liquid chamber 110 is filled with the liquid up to the highest fluid level FL1 of the predetermined capacity range and the first side wall 111 is positioned lower in the vertical direction, the liquid outlet 120 is positioned above the fluid level of ink (the fluid level FL2). Thus, in this tipped-over state, the ink is more reliably prevented from flowing out of the liquid outlet 120.

Moreover, in the tipped-over state shown in FIG. 13 where the liquid chamber 110 is filled with the liquid up to the highest fluid level FL1 of the predetermined capacity range and the first side wall 111 is positioned lower in the vertical direction, the air release hole 163, in addition to the liquid outlet 120, is also positioned above the fluid level of ink (the fluid level FL2). With this position of the air release hole 163, the ink in the liquid chamber 110 can be prevented from entering the air introduction path from the air release hole 163.

It should be noted that, in the tipped-over state, the filter 170 hardly receives the fluid pressure of ink and also causes the channel resistance to increase as compared with the case where the filter 170 is not provided. Thus, this configuration can further prevent the ink from flowing into the liquid communication path 130 and make the menisci of the nozzles of the print head 22 harder to damage.

With the configuration of the tank 100 according to the embodiment described thus far, the liquid outlet 120 is positioned at an end part of the first liquid communication path 131 near the second side wall 112, that is, at the end part near the second side wall 112 located away from the print head 22 than the first side wall 111 in the in-use state. Thus, when circumstances cause the tank 100 to be above the print head 22, the liquid outlet 120 is located near the second side wall 112 which is in the upper part of the tank 100. This configuration can prevent the liquid in the liquid chamber 110 from flowing out of the liquid outlet 120 and thus prevent leakage of the ink in the tank 100 from the print head 22 in the printer 11. In addition, suppose that when ink is injected from the liquid inlet 150, foreign matter enters the ink in the liquid chamber 110. In this case, the filter 170 provided for the first liquid communication path 131 can prevent the liquid communication path 130 and the print head 22 from being clogged with this foreign matter.

Furthermore, in the state where the liquid chamber 110 is filled with ink up to the highest fluid level FL1 of the predetermined capacity range and the first side wall 111 is positioned lower in the vertical direction, the liquid outlet 120 is positioned above the fluid level of ink (the fluid level FL2). This configuration can reliably prevent the ink in the liquid chamber 110 from flowing out of the liquid outlet 120.

Moreover, one side of the liquid chamber 110, one side of the first liquid communication path 131, and one side of the second liquid communication path 132 can be formed to share one and the same film (i.e., the first sheet member 102). This configuration can reduce the manufacturing cost and time of the tank 100. Furthermore, the exterior wall 119, which is included in the liquid chamber 110, is a part of the wall forming the liquid communication path 130. Thus, as compared with the case where the exterior wall 119 and the liquid communication path 130 are formed separately, the tank 100 can be reduced in size and manufactured in a shorter time as well.

Moreover, the filter 170 is disposed to contact with the liquid outlet 120 (the protrusion 124). Thus, as compared with the case where the filter 170 is disposed at a different position of the liquid communication path 130, this configuration can simplify the structure and reduce the manufacturing cost and size of the tank 100.

B. Further Embodiments

B-1. Further Embodiment 1

Although the tank 100 is positioned on the front side to be more forward (in the +Y direction) than the print head 22 in the in-use state in the above embodiment, the invention is not limited to this. For example, the tank 100 may be positioned to be more backward (in the −Y direction) than the print head 22. Moreover, the tank 100 may be positioned more to the side in the +X direction than the print head 22, or more to the side in the +Z direction than the print head 22. With each of these configurations, the second side wall 112 is positioned farther away from the print head 22 than the first side wall 111 is in the in-use state. Thus, when the print head 22 is located below the tank 100 in the tipped-over state, the ink in the liquid chamber 110 can be prevented from leaking from the print head 22.

B-2. Further Embodiment 2

In the above embodiment, when the liquid chamber 110 is filled with ink up to the highest fluid level FL1 of the predetermined capacity range and the first side wall 111 is positioned lower in the vertical direction, the liquid outlet 120 is positioned above the fluid level of ink (the fluid level FL2). However, the invention is not limited to this. In the above state, the liquid outlet 120 may be positioned below the fluid level of ink. Even with this configuration, the liquid outlet 120 is positioned at the end part of the first liquid communication path 131 near the second side wall 112, that is, at the end part near the second side wall 112 located away from the print head 22 than the first side wall 111 in the in-use state. Thus, as compared with a configuration where the liquid outlet 120 is positioned at an end part near the first side wall 111, leakage of the ink in the liquid chamber 110 from the print head 22 can be prevented. Similarly, when the liquid chamber 110 is filled with ink up to the highest fluid level FL1 of the predetermined capacity range and the first side wall 111 is positioned lower in the vertical direction, the air release hole 163 may be positioned below the fluid level of ink.

B-3. Further Embodiment 3

In the above embodiment, the bottom wall 114 in the −Z direction is a part of the wall forming the first liquid communication path 131, and the first side wall 111 in the −Y direction is a part of the wall forming the second liquid communication path 132. However, the invention is not limited to this. The bottom wall 114 and the first liquid communication path 131 may be formed separately. Similarly, the first side wall 111 and the second liquid communication path 132 may be formed separately.

B-4. Further Embodiment 4

Figure 14:
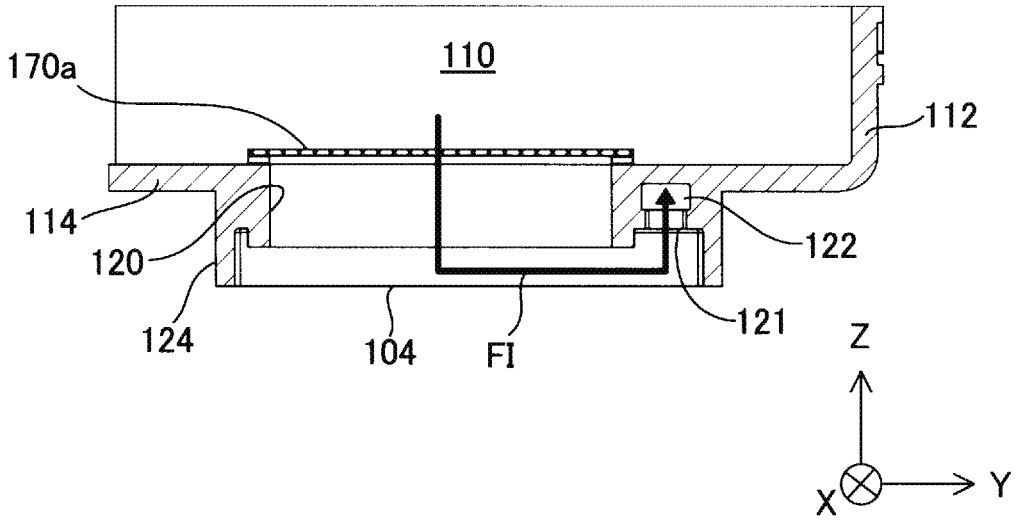
FIG. 14 is an enlarged cross-sectional view of the vicinity of a liquid outlet according to Further Embodiment 4.

In the above embodiment, the filter 170 is provided outside the liquid chamber 110. However, the filter 170 may be provided inside the liquid chamber 110. FIG. 14 is an enlarged cross-sectional view of the vicinity of a liquid outlet 120 according to Further Embodiment 4. The cross-sectional view in FIG. 14 is taken along the same line as in FIG. 11. In the example shown in FIG. 14, a filter 170*a* is provided inside a liquid chamber 110. With this configuration, even if foreign matter, such as a fragment, comes off an end part of the filter 170*a* and enters the ink in the liquid chamber 110, the filter 170*a* can capture this foreign matter. Thus, this configuration can prevent the foreign matter from flowing to the print head 22 and also prevent the nozzles of the print head 22 from being clogged, for example. Even when a filter cannot be provided at any position in the ink channel from the liquid outlet 120 to the print head 22, this configuration can prevent entry of foreign matter into the ink supplied to the print head 22.

B-5. Further Embodiment 5

In the above embodiment, the liquid supply port 140 is positioned at the end part in the upper part (near the upper wall 113) of the second liquid communication path 132. However, the invention is not limited to this. The liquid supply port 140 may be positioned in the upper part other than the end part of the second liquid communication path 132. Alternatively, the liquid supply port 140 may be positioned in a center part of the second liquid communication path 132 in the Z axis direction, or in a lower part of the second liquid communication path 132.

B-6. Further Embodiment 6

The invention is not limited to the tank used in an inkjet printer, and applicable to a tank used in any liquid ejection device that ejects a different kind of liquid other than ink. For example, the invention is applicable to tanks used in various liquid ejection devices as follows.

1. Image recording device, such as facsimile
2. Color material ejection device used for manufacturing color filter for image display device, such as liquid crystal display
3. Electrode ejection device used for forming electrode of organic EL (Electro Luminescence) display and surface-emitting display (FED: Field Emission Display)
4. Liquid ejection device that discharges liquid containing bioorganic substance used in biochip manufacturing
5. Specimen ejection device as precision pipette 6. Lubricant ejection device 7. Liquid resin ejection device 8. Liquid ejection device that ejects lubricant to precision instrument, such as watch and camera, with pinpoint accuracy 9. Liquid ejection device that ejects transparent liquid resin, such as ultraviolet curable liquid resin, to form, for example, micro hemispherical lens (optical lens) used for element, such as optical communication element 10. Liquid ejection device that ejects acid or alkaline etching liquid to etch, for example, substrate 11. Other liquid ejection device provided with liquid ejection head that discharges micro droplet in any amount It should be noted that the term "droplet" refers to liquid that is ejected from a liquid ejection device and that examples of the "droplet" include granular, tear-like, and stringy liquids. Moreover, the "liquid" may be any material that can be ejected by a liquid ejection device. For example, the "liquid" may be any material in which substance is in the liquid phase. Thus, examples of the "liquid" include high- and low-viscosity materials in the fluid state, sol, gel water, and other materials in the fluid state, such as inorganic solvent, organic solvent, solution, liquid resin, and liquid metal (metallic melt). Furthermore, examples of the "liquid" includes not only liquid of substance in one phase, but also melted, dispersed, and mixed materials in which particles of functional material made of solid matter, such as pigment and metal metallic particles, are melted, dispersed, and mixed into solvent. Typical examples of the liquid include ink and liquid crystal as described in the above embodiments. Here, examples of ink include typical water-based and oil-based ink and various kinds of liquid composition, such as gel ink and hot melt ink.

The invention is not limited to the above-described embodiments and thus can be implemented in various configurations without departing from the spirit of the invention. For example, technical features in the embodiments that correspond to technical features in the aspects described in SUMMARY above can be replaced and combined as necessary to solve some or all of the above-described problems or achieve some or all of the above-described advantageous effects. Moreover, technical features not described as being essential in the specification can be omitted as necessary.

This application claims the benefit of foreign priority to Japanese Patent Application No. JP2017-237834, filed Dec. 12, 2017, which is incorporated by reference in its entirety.

What is claimed is:

1. A tank mounted on a liquid ejection device to supply liquid to a liquid ejection head included in the liquid ejection device, the tank comprising:

a liquid chamber containing the liquid;

an air introduction inlet introducing air into the liquid chamber;

a liquid inlet configured to inject the liquid into the liquid chamber;

a liquid outlet from which the liquid in the liquid chamber flows out;

a liquid communication path causing the liquid from the liquid outlet to pass through the liquid communication path;

a liquid supply port configured to supply the liquid in the liquid communication path to the liquid ejection head;

a filter removing foreign matter from the liquid; and an exterior wall forming the liquid chamber and including: an upper wall positioned higher in an in-use state in which the liquid is ejected from the liquid ejection head; a bottom wall positioned lower in the in-use state; a first side wall crossing each of the upper wall and the bottom wall; and a second side wall crossing each of the upper wall and the bottom wall and positioned farther away from the liquid ejection head than the first side wall is in the in-use state, wherein the liquid communication path has: a first liquid communication path provided on an outer surface side of the bottom wall; and a second liquid communication path provided on an outer surface side of the first side wall and communicating with the first liquid communication path, each of the liquid outlet and the filter is positioned at an end part of the first liquid communication path near the second side wall, and the liquid supply port is positioned in the liquid communication path near the upper wall.

2. The tank according to claim 1, wherein when the liquid chamber is filled with the liquid up to a highest level of a predetermined capacity range and the first side wall is positioned lower in a vertical direction, the liquid outlet is positioned above a fluid level of the liquid.

3. The tank according to claim 1, wherein the liquid chamber has an opening enclosed by the exterior wall, the first liquid communication path has a first groove provided on the outer surface side of the bottom wall, and the second liquid communication path has a second groove provided on the outer surface side of the first side wall, the tank further comprising a film covering the opening, the first groove, and the second groove.

4. The tank according to claim 1, wherein the liquid chamber has an air release hole that communicates with the air introducing inlet, and the air release hole is positioned above a fluid level of the liquid when the liquid chamber is filled with the liquid up to a highest level of a predetermined capacity range and the first side wall is positioned lower in a vertical direction.

5. A liquid ejection device comprising:

the tank according to claim 1; and the liquid ejection head.

6. A liquid ejection device comprising:

the tank according to claim 2; and the liquid ejection head.

7. A liquid ejection device comprising:

the tank according to claim 3; and the liquid ejection head.

8. A liquid ejection device comprising:

the tank according to claim 4; and the liquid ejection head.

* * * * *